US008491738B2

(12) United States Patent
Foldesi, Jr. et al.

(10) Patent No.: US 8,491,738 B2
(45) Date of Patent: Jul. 23, 2013

(54) SINGLE TAB LID

(75) Inventors: Steve Foldesi, Jr., Hinesburg, VT (US); Steve Foldesi, Sr., Hinesburg, VT (US)

(73) Assignee: Nestech Machine Systems, Inc., Hinesburg, VT (US)

( * ) Notice: Subject to any disclaimer, the term of this patent is extended or adjusted under 35 U.S.C. 154(b) by 1433 days.

(21) Appl. No.: 12/157,006

(22) Filed: Jun. 7, 2008

(65) Prior Publication Data

US 2008/0302798 A1 Dec. 11, 2008

Related U.S. Application Data

(60) Provisional application No. 60/933,831, filed on Jun. 8, 2007.

(51) Int. Cl.
*B32B 37/00* (2006.01)

(52) U.S. Cl.
USPC ..... 156/73.1; 156/82; 156/257; 156/290; 156/308.4

(58) Field of Classification Search
USPC ..... 156/73.1, 82, 290, 292, 308.2, 308.4, 156/250, 256, 257, 272.8
See application file for complete search history.

(56) References Cited

U.S. PATENT DOCUMENTS

| | | | | |
|---|---|---|---|---|
| 4,315,791 | A | 2/1982 | Ishii | |
| 6,499,621 | B1 | 12/2002 | Yamaguchi | |
| 2005/0133508 | A1 | 6/2005 | Landis | |
| 2005/0189353 | A1 * | 9/2005 | Padovani | 220/276 |
| 2005/0269328 | A1 * | 12/2005 | Crider et al. | 220/276 |
| 2006/0006178 | A1 | 1/2006 | Foldesi, Sr. | |

FOREIGN PATENT DOCUMENTS

| | | | |
|---|---|---|---|
| GB | 2236099 | A | 3/1991 |
| MU | 8502287-0 | U | 6/2007 |
| WO | WO 2004043800 | A2 | 5/2004 |
| WO | WO 2005/056414 | A1 | 6/2005 |

OTHER PUBLICATIONS

International Search Report of PCT/US07/17832, Apr. 14, 2008.

* cited by examiner

*Primary Examiner* — James Sells
(74) *Attorney, Agent, or Firm* — James Marc Leas

(57) ABSTRACT

A packaging system includes a container and an unopened lid. The unopened lid includes a central planar region and a lid rim. The lid rim has a lid rim inner wall, a lid rim outer wall, a lid flange and a first tab. The first tab extends in a plane parallel to the central planar region. The first tab also extends outside the lid rim outer wall. A partially cut region is located on the lid rim outer wall, extends around most of the lid rim outer wall, and extends adjacent the first tab. The lid flange extends in a plane parallel to the central planar region. The lid flange also extends outside the lid rim outer wall. The container includes a container flange. The lid flange is welded to the container flange.

42 Claims, 15 Drawing Sheets

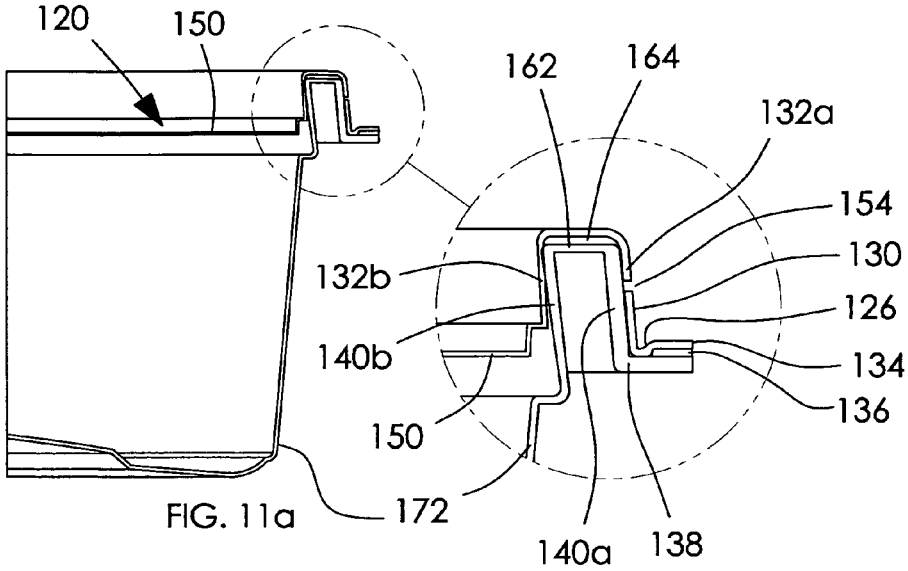
FIG. 11a
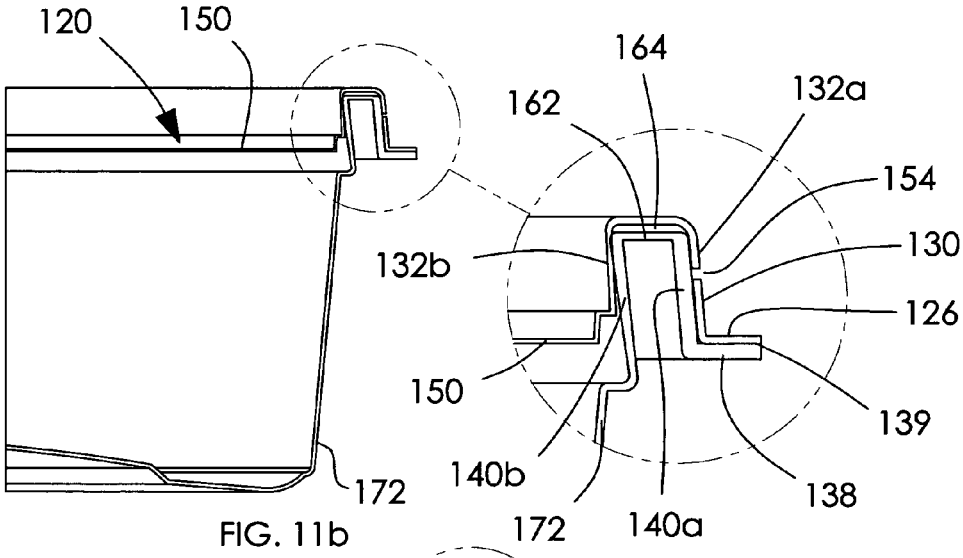
FIG. 11b
FIG. 11c
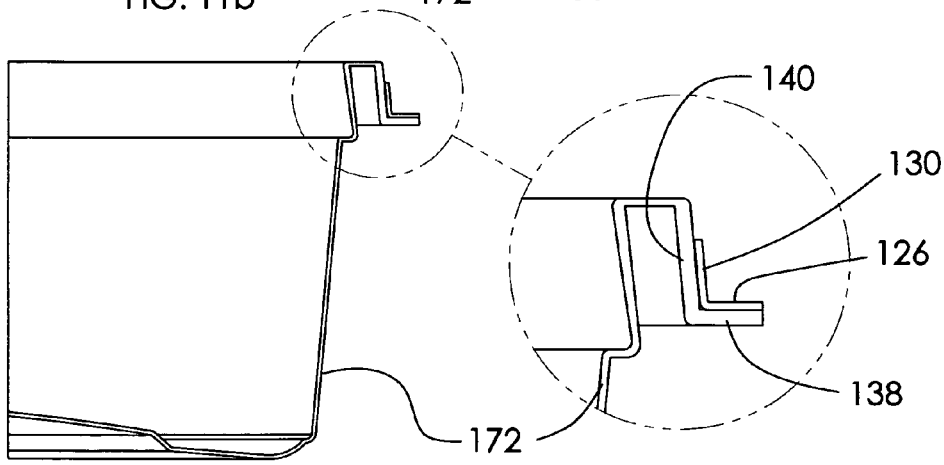

SINGLE TAB LID

RELATED APPLICATIONS

This patent application claims priority of commonly assigned U.S. Provisional Patent Application 60/933,831 "Single Tab Lid," filed Jun. 8, 2007, incorporated herein by reference.

This patent application is also related to commonly assigned U.S. Patent Application 2006/0006178 "Tamper-Indicating Food Container Lid," with application Ser. No. 11/167,995, filed Jun. 29, 2005, incorporated herein by reference.

This patent application is also related to commonly assigned U.S. patent application Ser. No. 11/503,687"Dual Tab Lid," filed Aug. 14, 2006, incorporated herein by reference.

This patent application is also related to PCT application PCT/US2007/017832 "Dual and Single Tab Lids," filed Aug. 10, 2007, incorporated herein by reference.

FIELD

This patent application generally relates to a lid for a container. More particularly, it relates to a system for securing a lid to a container for restricting or detecting tampering while providing easy access by the consumer.

BACKGROUND

Systems have been used, such as shrink wrap, to restrict access to a container as well as to make identifiable any such unwanted access to the container before purchase. Shrink wrapping has required a separate shrink wrap material to be applied in the area of the rim of the lid and extending down over the container, adding to expense for packaging. Shrink wrap has also been difficult for the consumer to remove, often impelling the consumer to resort to using a knife, which is inconvenient and could be somewhat dangerous to the consumer.

A system described in commonly assigned US patent application Ser. No. 11/167,995 and publication number 2006/0006178, "Tamper-Indicating Food Container Lid," avoids these problems by providing an outer rim member that engages the rim of the container to prevent tampering. This outer rim member includes laser slitting, allowing the outer rim member to be removed by the consumer. The outer rim member also includes a tab for the consumer to hold onto while removing the outer rim. The tab is formed in the laser slitting process.

However, further improvement has been desired to prevent tampering while providing an easy to remove lid, and solutions are provided in the following.

SUMMARY

One aspect of the present patent application is a packaging system that includes a container and an unopened lid. The unopened lid includes a central planar region and a lid rim. The lid rim has a lid rim inner wall, a lid rim outer wall, a lid flange and a first tab. The first tab extends in a plane parallel to the central planar region. The first tab also extends outside the lid rim outer wall. A partially cut region is located on the lid rim outer wall, extends around most of the lid rim outer wall, and extends adjacent the first tab. The lid flange extends in a plane parallel to the central planar region. The lid flange also extends outside the lid rim outer wall. The container includes a container flange. The lid flange is welded to the container flange.

Another aspect is a packaging system that includes an unopened lid and a container. The unopened lid includes a central planar region and a lid rim region. The lid rim region has a lid rim and a lid flange. The lid rim region surrounds the central planar region. The lid rim has a lid rim inner wall and a lid rim outer wall. The lid flange extends outside the lid rim outer wall in a plane substantially parallel with the central planar region. The container includes a container rim and a container flange. The lid rim fits on the container rim. The container flange extends in a plane substantially parallel with the lid flange. The lid flange is welded to the container flange. The lid flange includes a tab and the container flange includes a recess facing the tab.

Another aspect is a packaging system that includes an unopened lid and a container. The unopened lid includes a central region and a lid rim region. The lid rim region has a lid rim and a lid flange. The lid rim region surrounds the central region. The lid rim has a lid rim inner wall and a lid rim outer wall. The lid rim is located between the central region and the lid flange. The container includes a container rim and a container flange. The lid rim fits on the container rim. The lid flange and the container flange extend in a plane substantially parallel with the central region. The lid flange includes a dimple for facilitating hot air penetration between the lid flange and the container flange, and the lid flange is welded to the container flange at the dimple.

Another aspect is a method of fabricating a package. The method includes providing a lid, wherein the lid includes a central planar region and a lid rim region. The lid rim region has a lid rim and a lid flange, wherein the lid rim region surrounds the central planar region. The lid rim has a lid rim inner wall and a lid rim outer wall. The lid rim is located between the central planar region and the lid flange. The lid flange extends in a plane substantially parallel with the central planar region and the lid flange includes a tab. The method also includes providing a container including a container rim and a container flange, wherein the lid rim fits on the container rim. The container flange extends in a plane substantially parallel with the lid flange and the container flange includes a recess facing the tab. The method also includes welding the lid flange to the container flange.

Another aspect is a method of fabricating a package. The method includes providing a container having a container flange. It also includes providing a lid, wherein the lid includes a central region and a lid rim region. The lid rim region has a lid rim and a lid flange, wherein the lid rim region surrounds the central region. The lid rim has a lid rim inner wall and a lid rim outer wall, wherein the lid rim is located between the central region and the lid flange. The lid flange extends in a plane substantially parallel with the container flange. The lid flange includes a dimple for facilitating hot air penetration between the lid flange and the container flange. The method also includes welding the lid flange to the container flange at the dimple.

BRIEF DESCRIPTION OF THE DRAWINGS

FIG. 11*b* is a cross sectional view of the embodiment of the packaging system of FIG. 7 after the lid has been welded to the container and before the lid has been opened;

FIG. 11*c* is a cross sectional view of the embodiment of the packaging system of FIG. 7 after the lid has been opened showing the welded flange of the lid still connected to the container;

FIG. 11*a*' is a cross sectional view of the embodiment of the packaging system of FIG. 7 while the lid is being welded to the container.

DETAILED DESCRIPTION

Figure 1A:
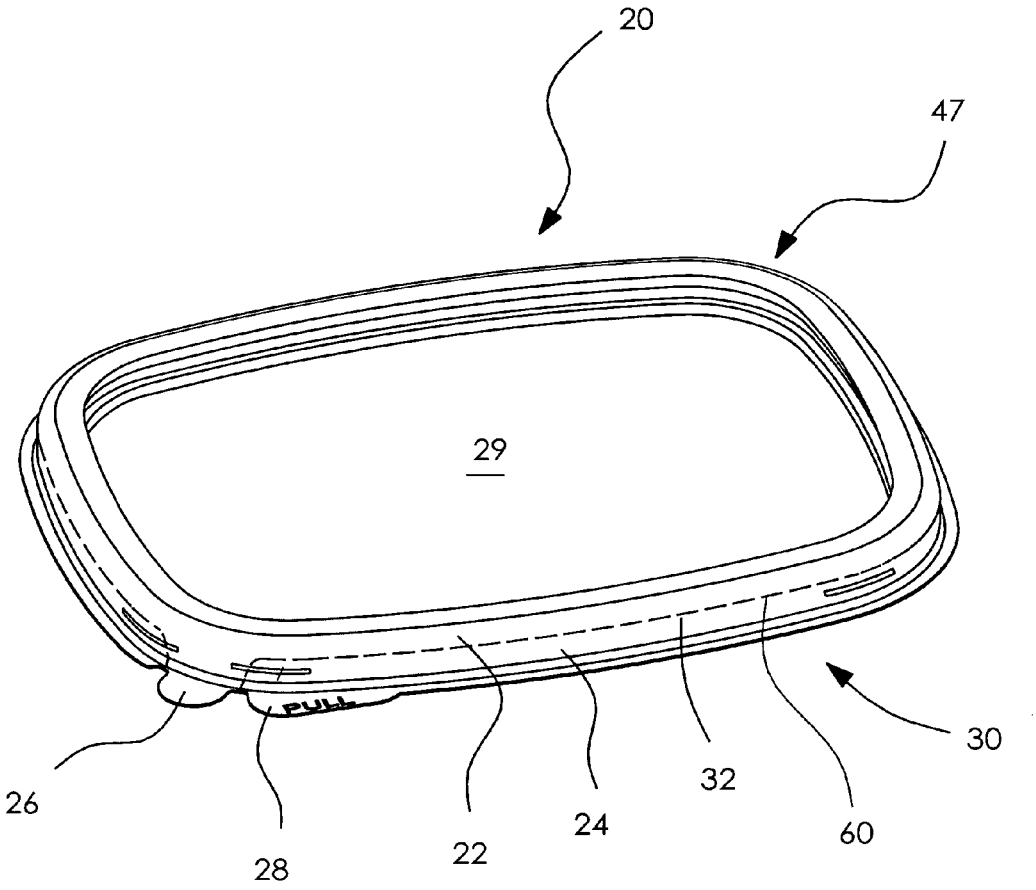
FIG. 1*a* is a three dimensional view of the lid of the present patent application with its removable portion in place and showing two coplanar tabs.
Figure 1B:
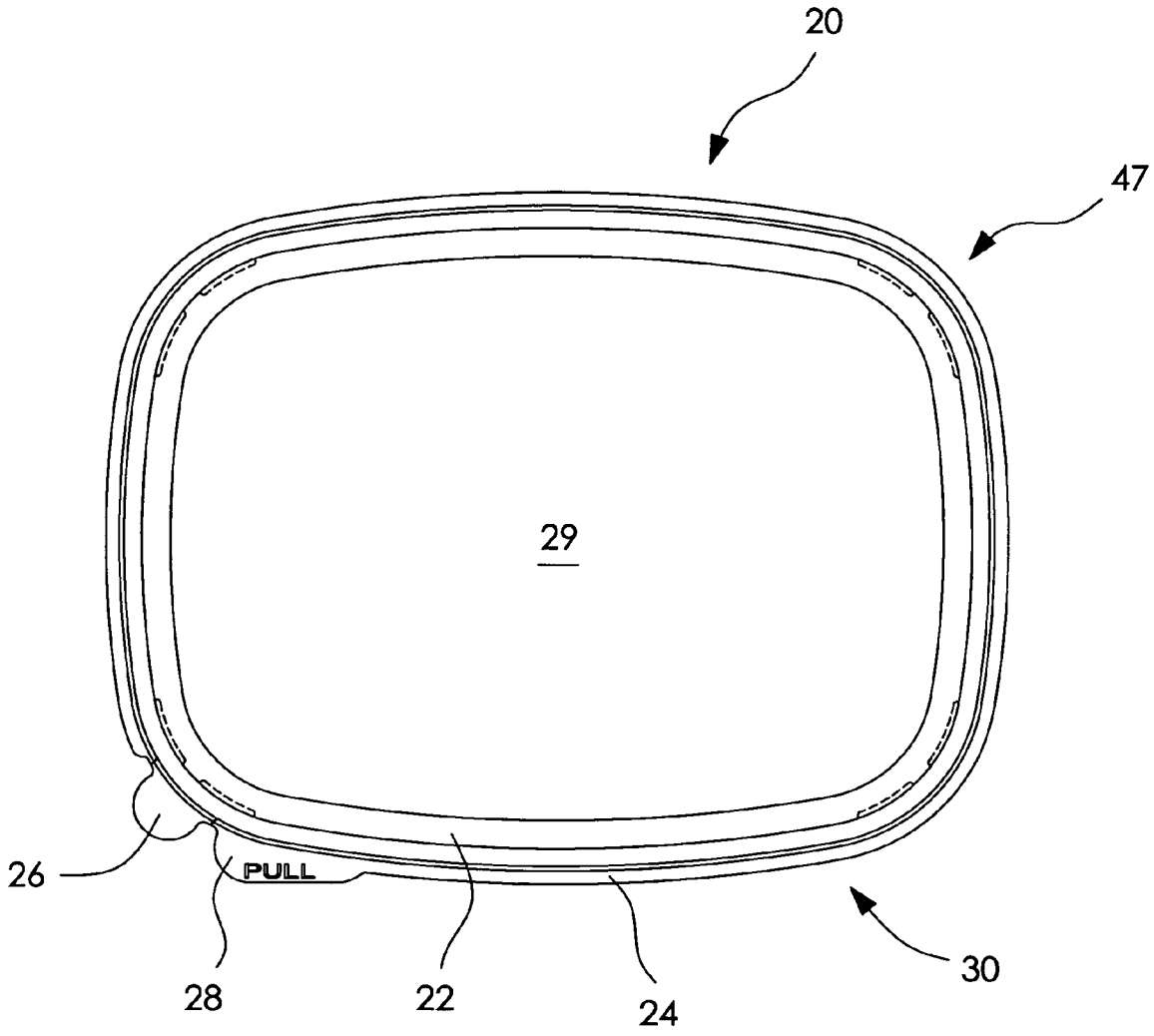
FIG. 1*b* is a top view of the lid of FIG. 1*a;*

One aspect of the present patent application is a packaging system that includes lid 20 having permanent portion 22 and removable portion 24, as shown in FIGS. 1*a*-1*b* and FIGS. 2*a*-2*b*. Permanent portion 22 includes first tab 26 and removable portion 24 includes second tab 28. These tabs 26, 28 may be adjacent each other. Both tabs 26, 28 extend outwardly from lid rim 30 so the consumer can easily find and grasp tab 26 in the left hand and tab 28 in the right hand. Tab 26 and tab 28 may extend in the same plane. Tab 26 and tab 28 can be in the same plane as planar portion 29 of lid 20. The consumer can hold first tab 26 on permanent portion 22 while pulling on second tab 28 on removable portion 24 to completely remove that removable portion 24. Partially cut line 32 makes removal easy. Second tab 28 may include a label directing a user to "pull" the second tab.

Figure 3A:
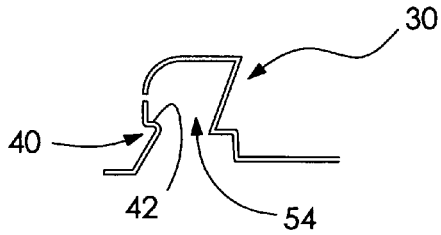
FIG. 3*a* is a cross sectional view of the lid of FIG. 1*a* showing a latching region.
Figure 4A:
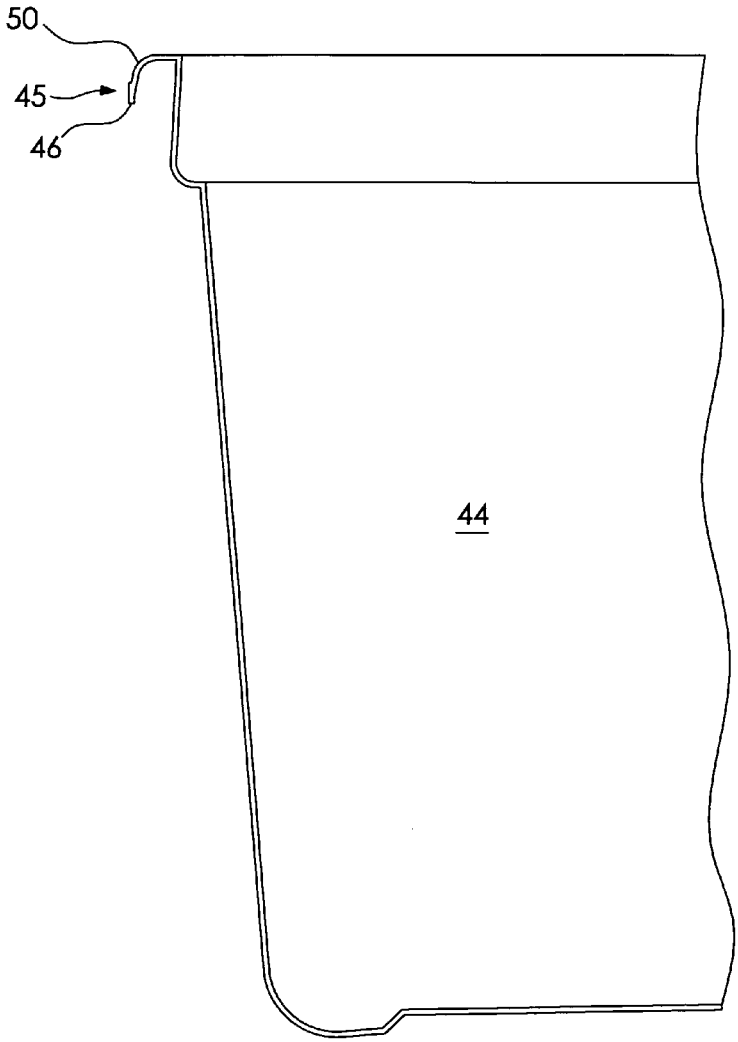
FIG. 4*a* is a cross sectional view of a container for mating with the lid of FIG. 1*a;*

Removable portion 24 can include latching region 40 with indentation 42 extending inward toward container 44. Latching region 40 holds lid 20 firmly on container 44 while removable portion 24 is in place on lid 20, as shown in FIG. 3*a*. Removal of lid 20 from container 44 is restricted as long as removable portion 24 remains substantially in place. Container latch receiving region 45 may simply include edge 46 of container 44, as shown in FIGS. 4*a*-4*b*.

Figure 4B:
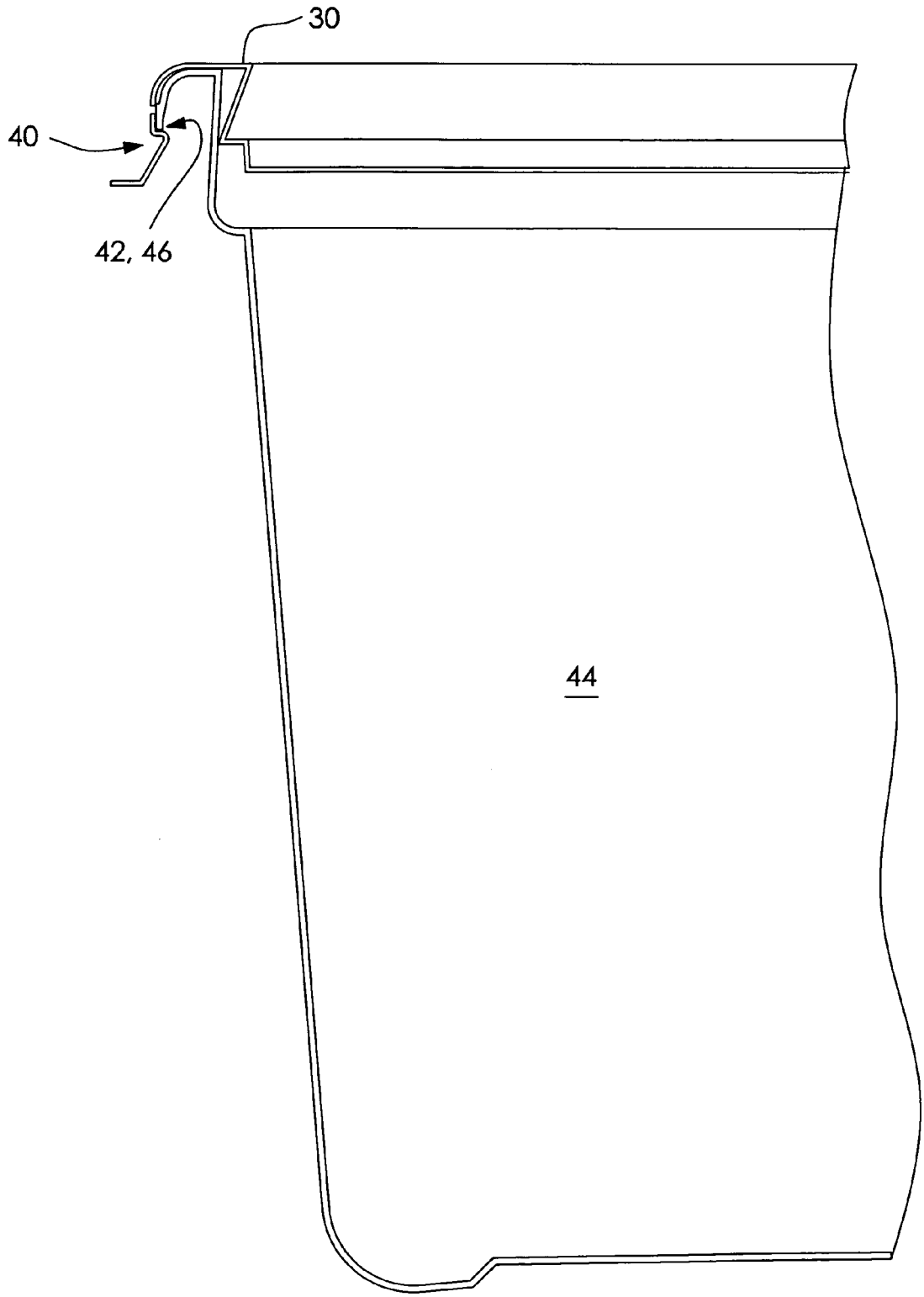
FIG. 4*b* is a cross sectional view of the container of FIG. 4*a* mating with the lid of FIG. 1*a* and showing the latching of indented portions of the lid with an edge of the container.

Since lid latching region 40 with its indentation 42 is substantially located on removable portion 24, removal of removable portion 24 by the consumer removes this latching region 40 and thus allows easy removal of lid 20 from container 44, shown in FIG. 4*b*. Several such latching regions 40 can be provided spaced around lid rim 30. For example, one latching region 40 can be provided on each side at each corner 46 of lid 20, as shown in FIGS. 1*a*-1*b*, 2*a*-2*b*, providing a total of eight latching regions 40. While indentations 42 can be provided all around removable portion 24, the present applicants found that spaced removable portions provided adequate restraint from improper removal of lid 20. On rectangular lids latching regions may, for example, be on each side of each corner 47. On round lids latching regions may, for example, be uniformly spaced around removable portion 24.

Figure 3B:
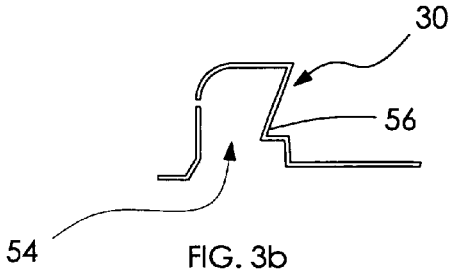
FIG. 3*b* is a cross sectional view of the lid of FIG. 3*a* showing a part between such latching regions.
Figure 5A:
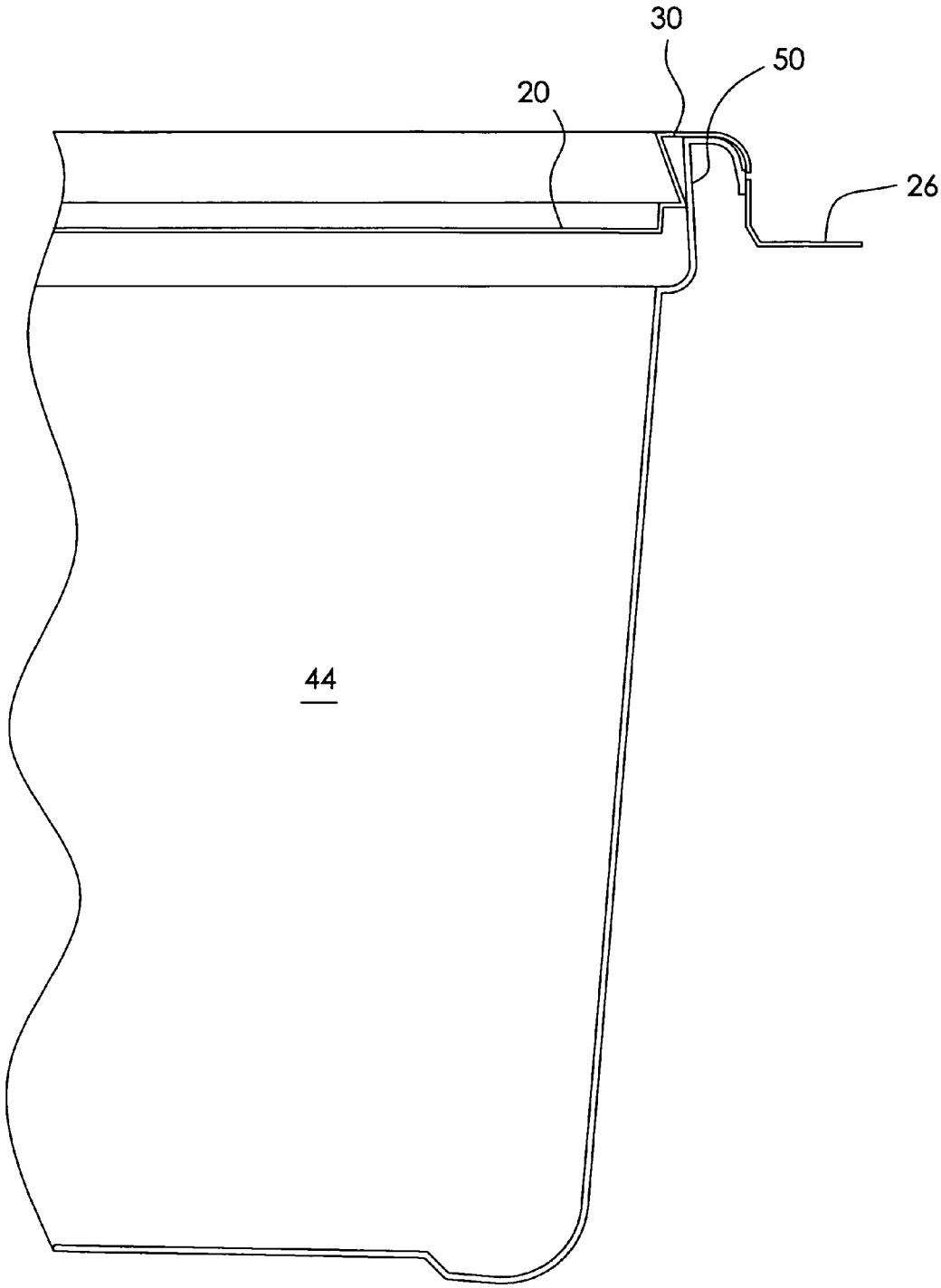
FIG. 5*a* is a cross sectional view of the container of FIG. 4*a* mating with the lid of FIG. 1*a* through the first tab of the lid, showing the first tab of the lid extending in the same plane as the planar region of the lid.

In space between latching regions 40 indentation 42 is not provided, as shown in FIG. 3*b* and in FIG. 5*a*.

Figure 2A:
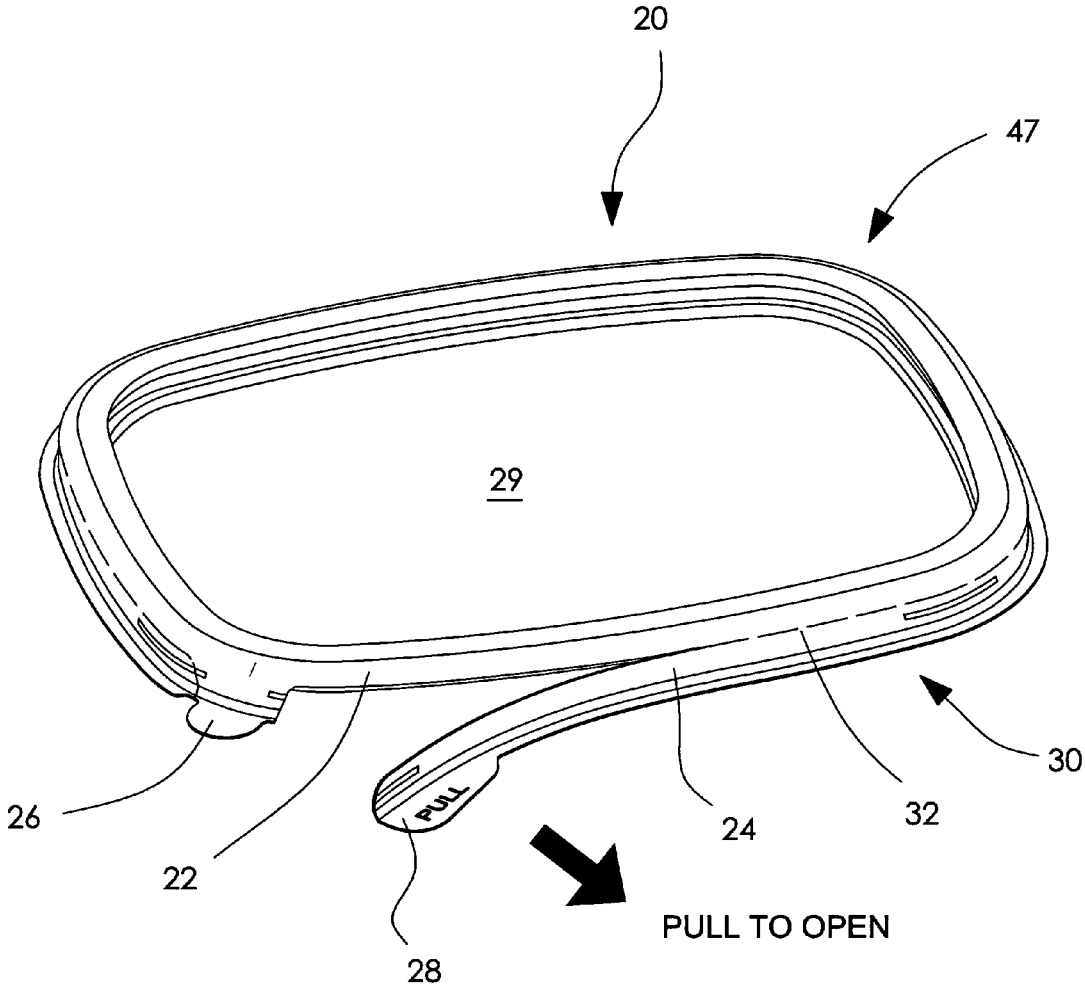
FIG. 2*a* is a three dimensional view of the lid of FIG. 1*a* after the tab on the removeable portion has been pulled to remove part of the removable portion.
Figure 2B:
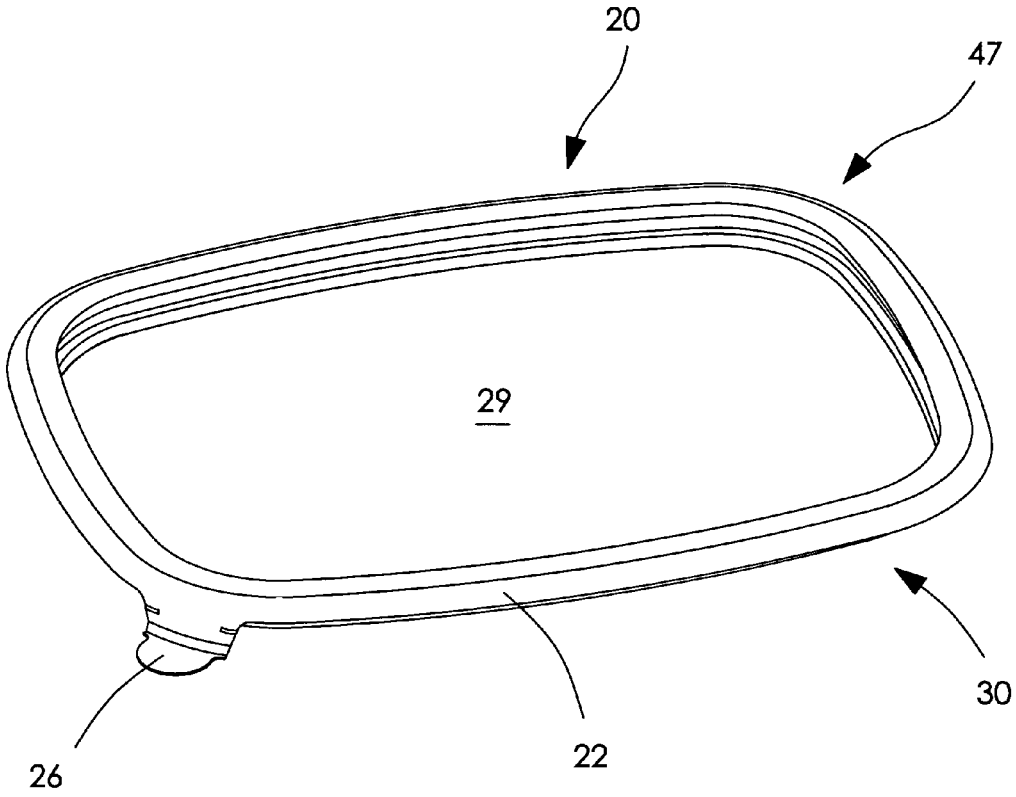
FIG. 2*b* is a three dimensional view of the lid of FIG. 2*a* after the tab on the removable portion has been pulled to remove the entire removable portion.
Figure 5B:
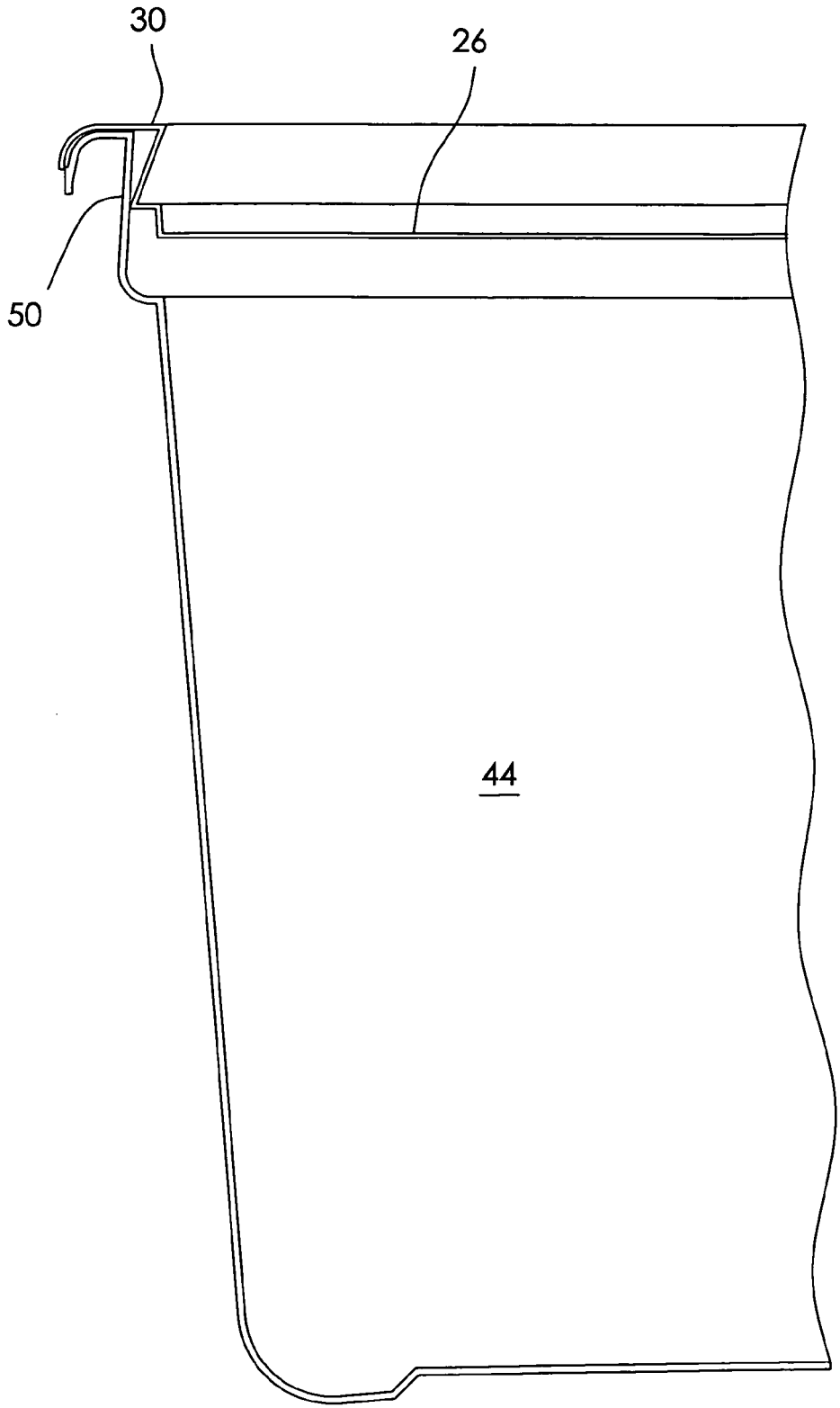
FIG. 5*b* is a cross sectional view of the container of FIG. 5*a* mating with the lid of FIG. 1*a* after removal of the removable portion and outside of the region of the first tab of the lid.

First tab 26 still remains in place on lid 20 after removable portion 24 has been removed, facilitating lid removal from container 44 and lid replacement on container 44, as shown in FIG. 2*b* and in FIG. 5*a*. In this region and in other regions around lid rim 30, a pressure fit holds container rim 50 to lid rim 30, as shown in FIGS. 5*a*, 5*b*. This pressure fit results from sizing of container rim 50 slightly larger than interior space 54 of lid rim 30, as shown in FIGS. 3*a*-3*b*, as well as from the shape provided to sidewalls 56 of lid rim 30. Thus, lid 20 initially has two mechanisms holding it to container 44, the pressure fit and the latching. Once removable portion 24 has been removed, lid 20 is held to container 44 with only the pressure mechanism.

Partially cut line 32 is located between permanent portion 22 and removable portion 24. Partially cut line 32 may include a plurality of holes 60. Holes 60 may be approximately equally spaced around lid rim 30. Holes 60 may be formed by laser cutting using a laser, such as the F201 $CO_2$ laser from Synrad, Inc., Mukilteo, Wash. The holes can also be formed by mechanically punching. They may also be formed with a cutting knife. The holes may be slit shaped as shown in FIG. 1*a*. Long slots are at least twice the length of the spaces there between. The first tab can include holes extending on both of its sides, as shown in FIG. 1*a*. In one embodiment the slot length was more than five times the spacing. Alternatively, a laser can also be used to scribe a continuous line, removing sufficient material to weaken the material.

Fabricating the package includes providing a container and providing a lid that includes a permanent portion and a removable portion, the permanent portion including a first tab and the removable portion including a second tab. The process further includes pressing the lid onto the container.

The removable portion can include a lid latching region and the container can include a container latching region, wherein the lid latching region is for latching the removable portion to the container latching region. The process of pressing the lid onto the container can include latching the lid latching region to the container latching region. Removal of the lid from the container is restricted as long as the removable portion, with its lid latching region, remains substantially in place.

Container 44 and its mating lid 20 can have any shape, such as square, rectangular, circular, or oval. Lid 20 can be fabricated using a process such as thermoforming or injection molding.

In using the package the consumer may pull on the second tab to remove the removable portion.

Figure 6A:
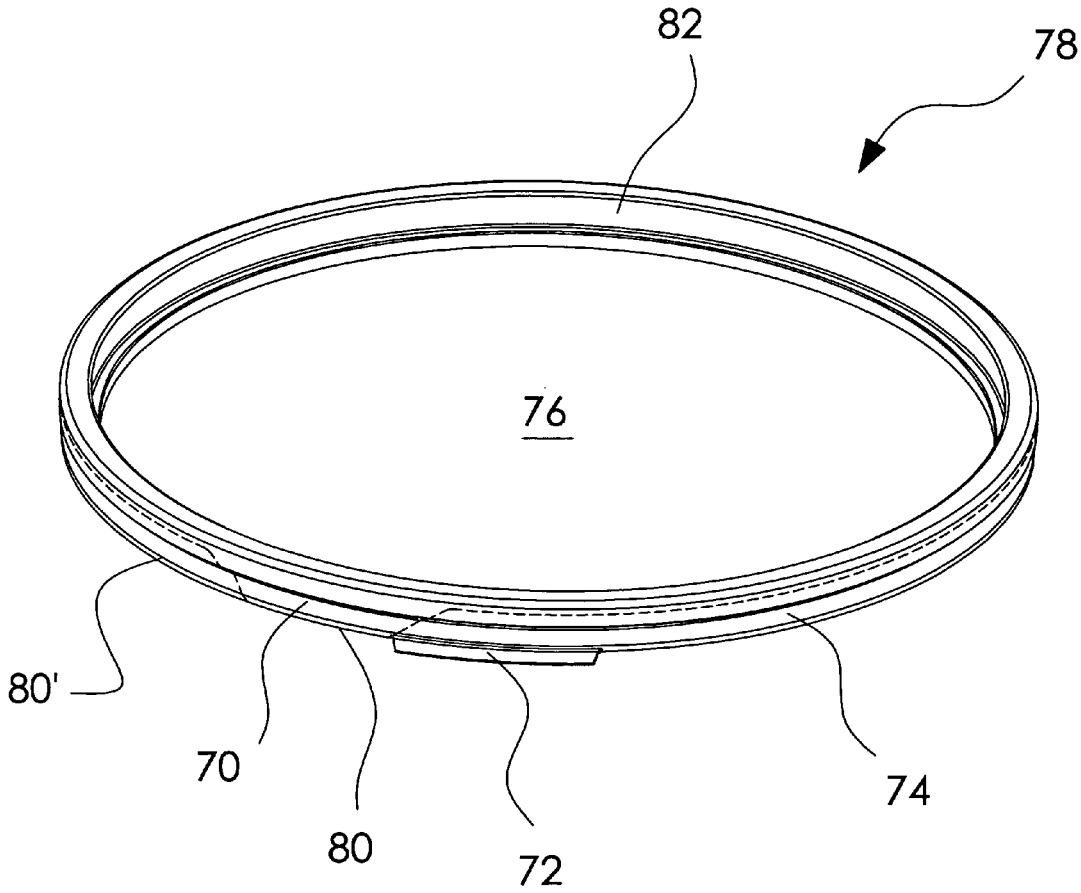
FIG. 6*a* is a three dimensional view of another embodiment of the lid of the present patent application with its removable portion in place and showing two different tabs.
Figure 6B:
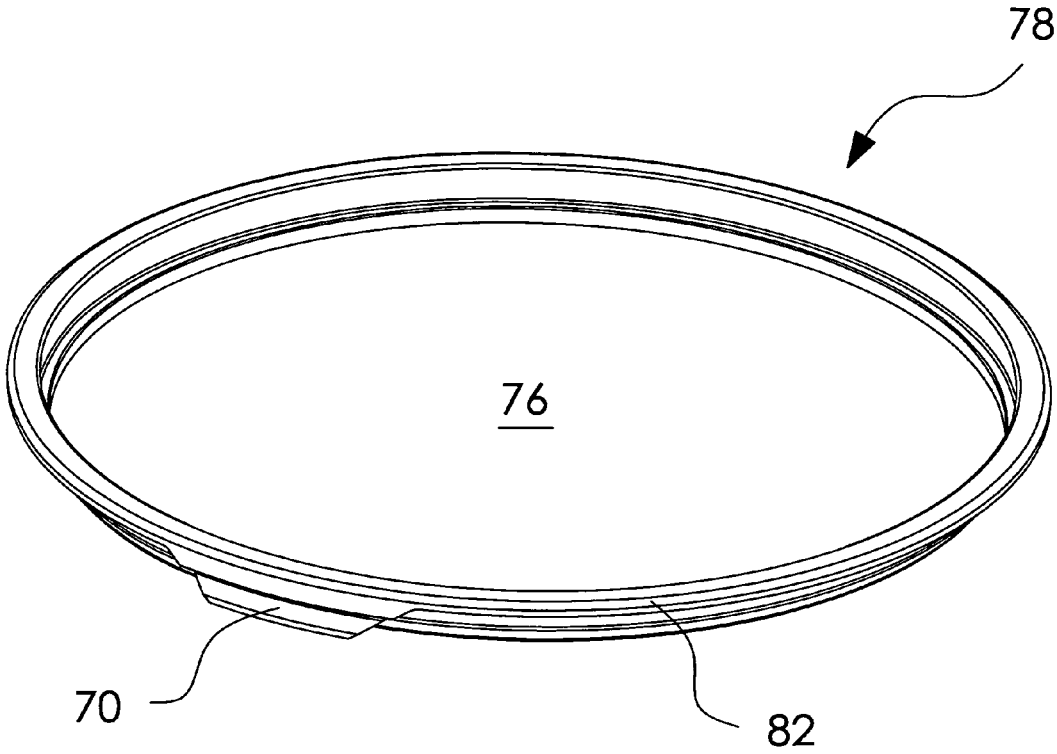
FIG. 6*b* is a three dimensional view of the embodiment of the lid of FIG. 6*a* after the removable portion has been removed.

Another embodiment with two differently shaped tabs 70, 72, as shown in FIG. 6*a*, 6*b*. Tab 72 extends from removable portion 74 in a plane parallel to planar region 76 of round lid 78. Tab 70 has bottom edge 80 following the contour of bottom edge 80' of removable portion 74. When tab 72 is pulled by the consumer to remove removable portion 74, remaining tab 70 is left extending down lower than other portions of rim 82 of round lid 78, as shown in FIG. 6*b*. In this embodiment the consumer may hold the container while pulling on removable tab 72 to entirely remove removable tab 72. The consumer will find that tab 70 can then be used to pull off lid 78.

The present patent application also provides a lid that is welded to a container to provide a more secure fastening than was provided by indentations 42 in latching region 40, as described herein above. The lid still has a convenient scheme for quickly opening the container while the welded portion remains attached to the container. One embodiment of the scheme provides a way to refasten the lid to the container with a friction seal.

Figure 11A:
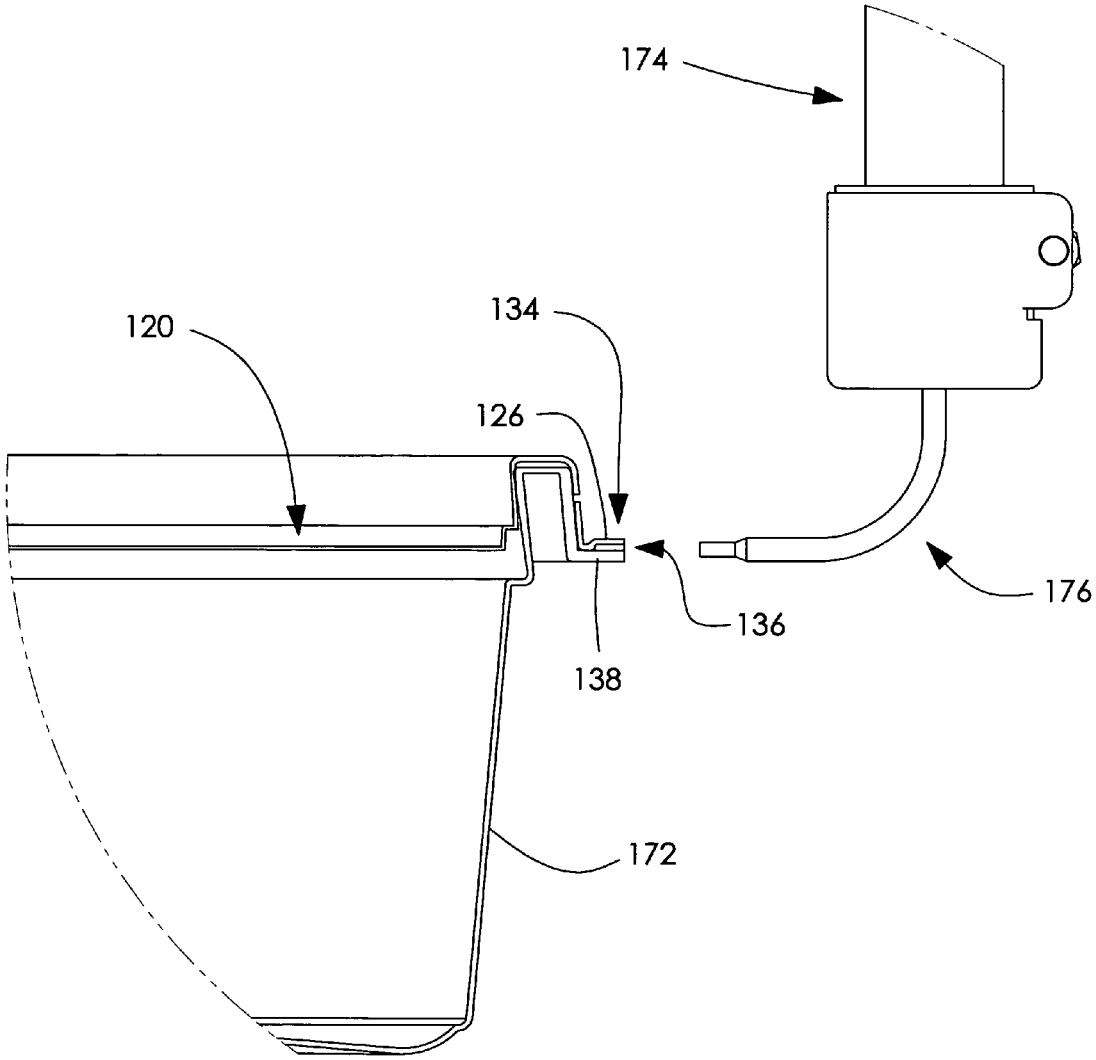
FIG. 11*a* is a cross sectional view of the embodiment of the packaging system of FIG. 7 before the lid has been welded to the container and before the lid has been opened.

One embodiment of the packaging system includes lid 120 having permanently attached portion 122 and removable portion 124, as shown in FIGS. 7, 8*a*, 9, 10*a*, and 11*a*-11*c*. Permanently attached portion 122 of lid 120 includes lid flange 126 and lower portion 130 of lid outer vertical wall 132. One embodiment of lid flange 126 initially includes dimples 134 that provide gap 136 between lid flange 126 and container flange 138, as shown in FIG. 11*a*. This gap allows for very hot air to penetrate between lid flange 126 and container flange 138, as shown in FIG. 11*a*', to melt some of the plastic on both flanges, and provide spot welding 139 when lid flange 126 is pressed against and container flange 138, as shown in FIG. 11*b*. The continued attachment of welded lid flange 126 after lid 120 has been opened is shown in FIG. 11*c*.

For clarity FIGS. 11*a*-11*c* show spaces between surfaces of lid flange 126 container flange 138 and between outer and inner vertical walls 132*a*, 132*b* of lid 120 and container outer and inner vertical walls 140*a*, 140*b*. In one embodiment these spaces will not be present as outer and inner vertical walls 132*a*, 132*b* of lid 120 are sized to friction fit on container outer and inner vertical walls 140*a*, 140*b*.

Lid 120 includes flat top portion 150 surrounded by rim portion 152. Rim portion 152 includes lid flange 126 that extends parallel to top portion 150. Rim portion 152 also includes partially cut line 154 that extends most of the way around rim portion 152. Partially cut line 154 includes holes 156 and bridges 158. Rim portion 152 also includes tab 160 that is pulled by the consumer when he or she wants to open lid 120. Partially cut line 154 makes opening lid 120 easy as bridges 158 account for only a fraction of partially cut line 154. Tab 160 extends parallel to top portion 150 and may extend beyond lid flange 126 for easy grasping. Tab 160 may include indentations or a rough surface for easier grasping. It may include a label directing the user to "pull." One embodiment of container flange 138 includes recess 161 in the region of tab 160 to avoid interfering with grasping tab 160 by the consumer.

In one embodiment, a pressure fit holds rim portion 152 of lid 120 to container rim 162. This pressure fit results from sizing of container rim 162 slightly larger than interior space 164 between inner and outer vertical walls 132*a*, 132*b* of lid rim 120.

Figure 7:
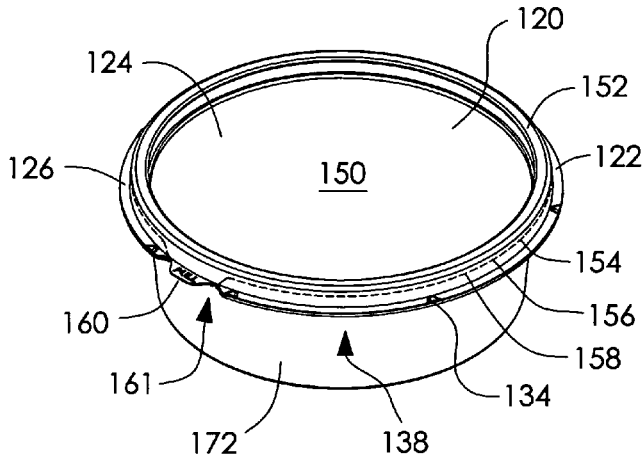
FIG. 7 is a three dimensional view of another embodiment of the packaging system of the present patent application before the lid has been opened.
Figure 8A:
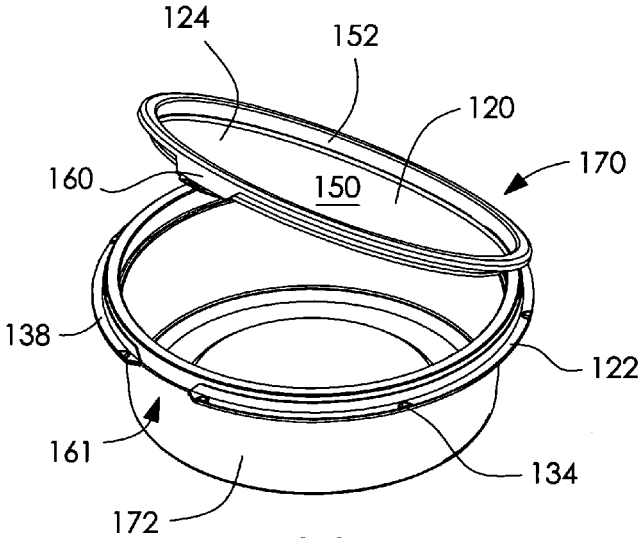
FIG. 8*a* is a three dimensional view of the embodiment of the packaging system of FIG. 7 after the lid has been opened.
Figure 8B:
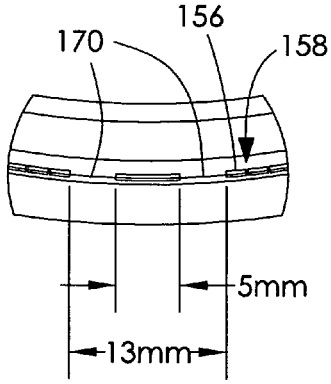
FIG. 8*b* is a detail view of the hinge region of the embodiment of the packaging system of FIG. 7.
Figure 9:
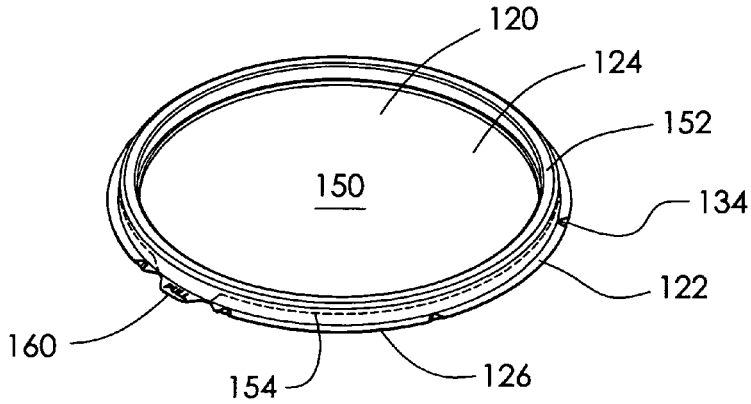
FIG. 9 is a three dimensional view of the lid of the packaging system of FIG. 7.
Figure 10B:
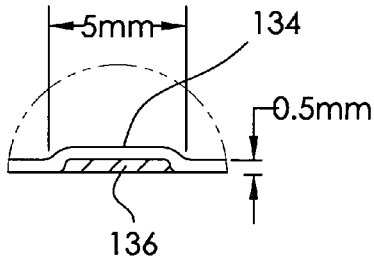
FIG. 10*b* is a detail front view of a dimple in a flange of the lid of the packaging system of FIG. 7.
Figure 10A:
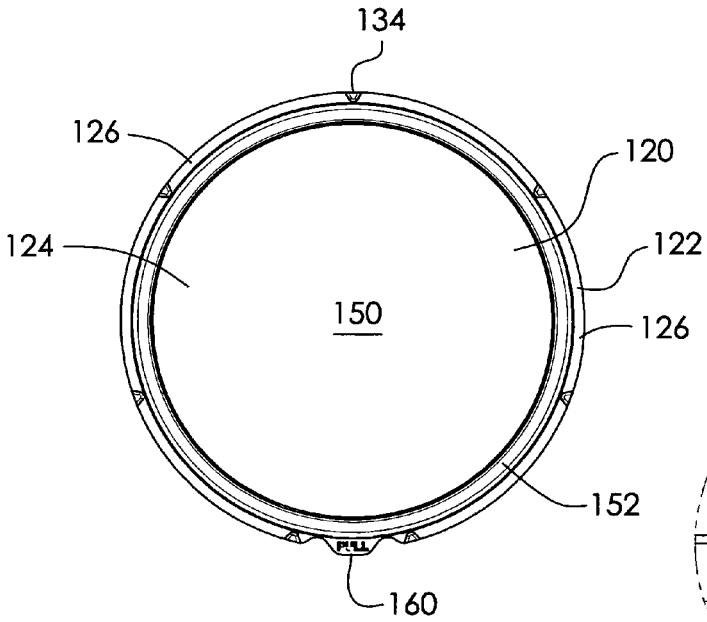
FIG. 10*a* is a top view of the lid of the packaging system of FIG. 7.
Figure 10C:
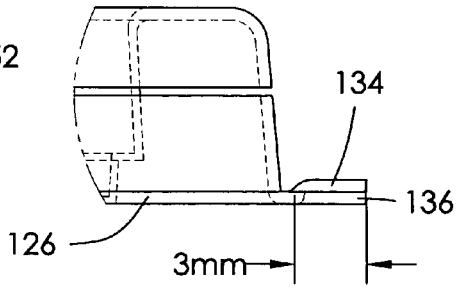
FIG. 10*c* is a detail side view of a dimple in a flange of the lid of the packaging system of FIG. 7.
Figure 12:
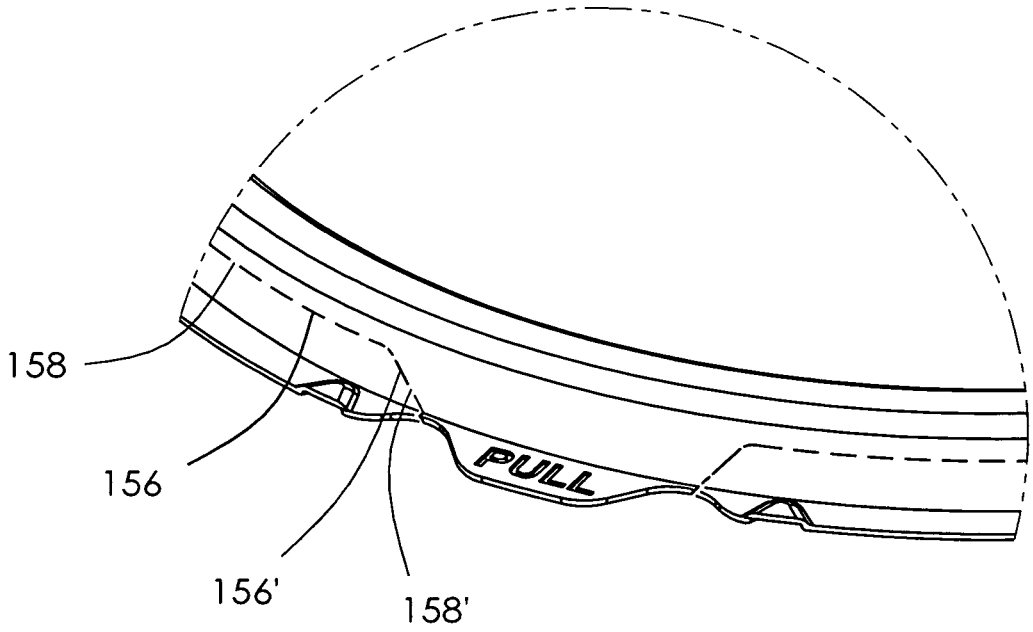
FIG. 12 is a three dimensional view of the lid of the packaging system of FIG. 7 showing details of the partially cut line used for opening the lid in the vicinity of the tab used for opening the lid.

Partially cut line 154 may include a plurality of holes 156. Holes 156 may be approximately equally spaced around lid rim 152. Holes 156 may be formed by laser scribing using a laser, such as F201 $CO_2$ laser from Synrad, Inc., Mukilteo, Wash. Using a laser to form the holes allows their location to be adjusted in two dimensions as well as varying their size and shape. Holes 156 may be slit shaped as shown in FIG. 7 and FIG. 8*b*. Near tab 160 a different configuration of holes can be provided than around other portions of the lid. For example, by providing smaller holes 156' and bridges 158' closer together, security against unwanted opening can be provided, as shown in FIG. 12. In addition opposite tab 160 a region can be provided without any holes or slits to form hinge 170. Thus, container 172 can be opened, as shown in FIG. 11*c*, while lid 120 remains attached to container 172 at hinge 170, as shown in FIGS. 8*a*, 8*b*.

Fabricating the package includes providing container 172 and providing lid 120 as described herein above. The process further includes pressing lid 120 onto container 172. In one embodiment, hot air guns 174 are provided in locations surrounding lid flanges 126 with nozzles 176 aiming at space 136 provided by dimples 134 in lid flange 126, as shown in FIGS. 10*a*-10*c*, FIG. 4*a*, and FIG. 5*a*'. Hot air is provided at a temperature in the range from about 350 to about 380 F to melt surface layers of the lid and container flanges 126, 138. Flanges 126, 138 are then pressed together to form spot welds 139.

In using the package the consumer may pull on tab 160 to open lid 120. The consumer can then close lid 120 with its friction fit to rim 162 of container 172.

Container 172 and its mating lid 120 can have any shape, such as square, rectangular, circular, or oval. Lid 120 can be fabricated using a process such as thermoforming or injection molding.

In another embodiment, ultrasonic welding can be used to weld lid and container flanges 126, 138. In one embodiment the weld can extend continuously around lid and container flanges 126, 138. With the ultrasonic welding dimples 134 would not be used.

While several embodiments, together with modifications thereof, have been described in detail herein and illustrated in the accompanying drawings, it will be evident that various further modifications are possible without departing from the scope of the invention as defined in the appended claims. Nothing in the above specification is intended to limit the invention more narrowly than the appended claims. The examples given are intended only to be illustrative rather than exclusive.

What is claimed is:

1. A method of fabricating a package, comprising:

a. providing a lid, wherein said lid includes a central planar region and a lid rim region, wherein said lid rim region has a lid rim, wherein said lid rim region surrounds said central planar region, wherein said lid rim has a lid rim inner wall and a lid rim outer wall, wherein said lid rim further includes a first tab, wherein said first tab extends in a plane parallel to said central planar region, wherein said first tab extends outside said lid rim outer wall;

b. providing a container, wherein said container includes a container rim region having, a container rim, wherein said lid rim fits on said container rim, wherein said lid rim inner wall is for positioning inside said container rim and wherein said lid rim outer wall is for positioning outside said container rim;

c. partially cutting a line in said lid rim outer wall, wherein said partially cutting includes at least one laser treating from the group consisting of laser scribing, laser cutting, and laser slitting, wherein said partially cutting provides a partially cut line extending around most of said lid rim outer wall, wherein said partially cut line defines a first portion of said lid rim outer wall and a second portion of said lid rim outer wall, wherein said partially cutting provides sufficient material weakening for pull-separating along said partially cut line when opening the package is desired, wherein said first tab is located for providing said pull-separating when said first tab is pulled; and d. welding said second portion to said container rim region.

2. A method as recited in claim 1, further comprising pulling on at least one from the group consisting of said first portion and said second portion to facilitate opening the package.

3. A method as recited in claim 1, wherein said laser treating includes forming holes.

4. A method as recited in claim 1, wherein said laser treating defines a plane, further comprising leaving a region of said lid in said plane free of said laser treating to provide a hinge.

5. A method as recited in claim 1, wherein said welding includes applying ultrasonic vibration to said second portion and to said container.

6. A method as recited in claim 1, wherein said welding includes applying hot air to said second portion and to said container.

7. A method as recited in claim 1, wherein said welding includes spot welding.

8. A method as recited in claim 7, further comprising before said spot welding forming dimples in said second portion, wherein said dimples provide a space between said lid and said container to facilitate entrance of said hot air.

9. A method as recited in claim 8, wherein said spot welding includes applying hot air to said space.

10. A method as recited in claim 7, wherein said welding includes pressing portions of said lid flange and said container flange together.

11. A method of fabricating a package, comprising:

a. providing a container having a container flange;

b. providing a lid, wherein said lid includes a central region and a lid rim region, wherein said lid rim region has a lid rim and a lid flange, wherein said lid rim region surrounds said central region, wherein said lid rim has a lid rim inner wall and a lid rim outer wall, wherein said lid rim is located between said central region and said lid flange, wherein said lid flange extends in a plane substantially parallel with said container flange, wherein said lid flange includes a dimple for facilitating hot air penetration between said lid flange and said container flange; and c. providing hot air and welding said lid flange to said container flange at said dimple.

12. A method as recited in claim 11, wherein said lid includes partially cutting a line around at least a portion of said lid for facilitating opening said container, wherein said partially cutting a line includes at least one laser treating from the group consisting of laser scribing, laser cutting, and laser slitting.

13. A method as recited in claim 12, wherein said partially cutting a line provides a partially cut line on said lid rim outer wall.

14. A method as recited in claim 13, further comprising a hinge region where said partial cutting is absent.

15. A method as recited in claim 13, wherein said partially cut line includes a plurality of holes.

16. A method as recited in claim 11, wherein said removable portion further includes a lid rim, wherein said lid rim inner wall and said lid rim outer wall extend approximately perpendicular to said central planar region, wherein said partially cut line is located on said lid rim outer wall.

17. A method of fabricating a package, comprising:

a. providing a lid, and providing said lid with a central planar region and a lid rim wherein said lid rim includes a lid rim inner wall, a lid rim outer wall, a tab, and a lid flange, wherein said tab extends in a plane parallel to said central planar region, wherein said tab extends outside said lid rim outer wall, wherein said lid flange extends in a plane parallel to said central planar region, wherein said lid flange extends outside said lid rim outer wall; and b. partially cutting a region on said lid rim outer wall, wherein said partially cutting includes at least one laser treating from the group consisting of laser scribing, laser cutting, and laser slitting, wherein said partially cutting provides a partially cut region extending around most of said lid rim outer wall, wherein said tab is located for providing for pull-separating along said partially cut region when said tab is pulled.

18. A method as recited in claim 17, wherein said partially cut region defines a plane, wherein in said providing a partially cut region a portion of said lid in said plane is free of said partial cutting to provide a hinge.

19. A method as recited in claim 17, wherein said partially cutting a region includes forming a plurality of holes.

20. A method as recited in claim 19, further comprising spacing said plurality of holes about equally apart.

21. A method as recited in claim 19, further comprising forming said plurality of holes to be slit-shaped.

22. A method as recited in claim 21, further comprising forming said plurality of slit-shaped holes with bridges between said slit-shaped holes.

23. A method as recited in claim 22, further comprising providing said bridges with a bridge length, wherein said bridge length is less adjacent said tab than removed from said tab.

24. A method as recited in claim 22, wherein said plurality of slit-shaped holes have a hole length and said bridges have a bridge length, further comprising forming said hole length at least two times said bridge length.

25. A method as recited in claim 17, wherein said lid rim inner wall and said lid rim outer wall extend approximately perpendicular to said central planar region.

26. A method as recited in claim 1, wherein said lid rim region further includes a lid flange, further comprising forming a dimple in said lid flange for facilitating hot air penetration between said lid flange and said container flange for providing said weld.

27. A method as recited in claim 1, further comprising forming a hinge region where said partial cutting is absent.

28. A method as recited in claim 1, wherein said forming a partially cut line involves forming a plurality of holes.

29. A method as recited in claim 28, wherein said forming a plurality of holes involves spacing said plurality of holes about equally apart.

30. A method as recited in claim 28, wherein said forming a plurality of holes involves forming said holes slit-shaped.

31. A method as recited in claim 30, wherein said forming a plurality of holes involves including bridges between said slit-shaped holes.

32. A method as recited in claim 15, further comprising forming said plurality of holes to be slit-shaped.

33. A method as recited in claim 32, further comprising forming said plurality of slit-shaped holes with bridges between said slit-shaped holes.

34. A method as recited in claim 33, further comprising providing said bridges with a bridge length, wherein said bridge length is less adjacent said tab than removed from said tab.

35. A method as recited in claim 11, wherein said container has a container rim region, further comprising shaping said lid rim region and said container rim region to fit together to provide a pressure fit for holding said lid to said container.

36. A method as recited in claim 1, wherein said lid rim region has a lid flange, wherein said container rim region has a container flange, wherein said lid rim is located between said central planar region and said lid flange, wherein said lid flange extends in a plane substantially parallel with said central planar region, wherein said lid flange includes a tab, wherein said container flange extends in a plane substantially parallel with said lid flange, wherein said container flange includes a recess facing said tab, wherein in said welding said second portion to said container rim region said lid flange is welded to said container flange.

37. A method as recited in claim 17, further comprising providing a container wherein said container includes a container flange, and welding said lid flange to said container flange.

38. A method as recited in claim 17, wherein said lid rim further includes a first tab, wherein said first tab extends in a plane parallel to said central planar region, wherein said first tab extends outside said lid rim outer wall.

39. A method as recited in claim 38, further comprising including said first tab in a portion of said lid flange.

40. A method as recited in claim 38, further comprising providing a container wherein said container includes a container flange, and welding said lid flange to said container flange, wherein said container flange includes a recess opposite said first tab.

41. A method as recited in claim 37, further comprising including a dimple in said lid flange, and using said dimple for facilitating hot air penetration between said lid flange and said container flange for performing said welding.

42. A method as recited in claim 37, wherein said container has a container rim wherein said container rim and said lid rim are shaped to fit together to provide a pressure fit for holding said lid to said container and press fitting said lid rim to said container rim.

* * * * *